United States Patent [19]

Milberger et al.

[11] Patent Number: 4,577,686

[45] Date of Patent: Mar. 25, 1986

[54] MUDLINE SUPPORT HANGER ASSEMBLY

[75] Inventors: Lionel J. Milberger; Glen E. Lochte, both of Houston; Anthony J. Masciopinto, Kingwood, all of Tex.

[73] Assignee: Vetco Offshore, Inc., Ventura, Calif.

[21] Appl. No.: 604,199

[22] Filed: Apr. 26, 1984

[51] Int. Cl.[4] ..... E21B 23/02

[52] U.S. Cl. ..... 166/208; 166/88

[58] Field of Search ..... 166/208, 88, 89, 381, 166/382, 206, 207

[56] References Cited

U.S. PATENT DOCUMENTS

| | | | |
|---|---|---|---|
| 3,273,646 | 9/1966 | Walker | 166/88 |
| 3,411,588 | 11/1968 | Hanes | 166/208 |
| 3,460,615 | 8/1969 | Watkins | 166/208 |
| 3,489,215 | 1/1970 | Regan | 166/208 |
| 3,963,074 | 6/1976 | Spriggs | 166/206 |
| 4,373,752 | 2/1983 | Nelson | 166/208 |

*Primary Examiner*—Stephen J. Novosad
*Assistant Examiner*—Bruce M. Kisliuk
*Attorney, Agent, or Firm*—Edward L. Kochey, Jr.

[57] ABSTRACT

A mudline casing hanger assembly with an elliptical support ring 20 which is run at an angle 46, rotated to horizontal 48, and landed 50. A support and flowby sleeve 16 to support the landing ring 20 is cut and inserted into a recess.

4 Claims, 7 Drawing Figures

MUDLINE SUPPORT HANGER ASSEMBLY

BRIEF DESCRIPTION OF THE INVENTION

The invention relates to mudline casing hangers, and in particular to a method and apparatus for placing a support ring within a first hanger body for supporting a second hanger body.

BACKGROUND OF THE INVENTION

In the drilling of subsea wells it is often desirable to support all casing strings at the mudline. This creates the problem of hanging a plurality of concentric strings of casing within one another from their respective hanger bodies. Since each hanger body and the supports therefore, must be run through a length of riser to reach the support elevation, there is a serious limitation on the annular space available to the supports to perform the required operations. The simple support arrangements available for surface wells are not available here.

U.S. Pat. No. 3,411,588 to J. W. E. Hanes illustrates the problem and one solution therefor. An internal circumferential slot is provided in a first casing hanger. The support ring is shaped having an inwardly extending support shoulder with the support ring being cut to form a so called C shaped member, and with this member being formed such that it naturally tends to spring outwardly into the slot.

The support ring is held in the contracted position, and lowered to a point slightly above the support elevation. It is thereafter released springing out against the inside surface of the riser. It is pushed down until it reaches and snaps into the annular groove in the hanger body. This provides the support ring for the next run casing hanger.

While the casing interior and support slot may be sprayed during running of the support ring, there is no assurance that all dirt or cement would be removed, and accordingly it is possible that the ring may not fully expand within the slot to provide a reliable support. It is also possible that it cock in such a way that it is actually recompressed when load is placed thereon, pushing it farther down the pipe rather than requiring it to stay in place and accept the load.

SUMMARY OF THE INVENTION

The support ring of the invention provides a full landing surface around its entire circumference for engagement with the later run hanger body. The first run casing hanger has a circumferential slot cut into its internal diameter. The slot houses a flowby sleeve which serves as a bridging member between the supporting casing hanger, and the support ring which is run to support the next hanger.

This flowby sleeve also provides fluid passage for liquids which must flow during cementing operations.

This flowby sleeve is machined from a full ring formed to a size which will fit within the slot. It is then sawed into three or more pieces with the pieces being reassembled into a ring formation inside the casing hanger slot, and welded together but not to the hanger body.

The support ring is initially machined into a ring shape such as it would fit within the sleeve recess, and also extend inwardly a sufficient amount to support the next hanger. Since the outside diameter of the support ring is larger than the inside diameter of the casing through which it must pass, and also the inside diameter of the first hanger body, additional machining and manipulation of the ring is required. The ring is placed on the turning arbor of a lathe at an angle, such as 35°, from a position perpendicular to the axis of the arbor. While held at this angle it is machined and reduced in diameter. This machining operation forms a substantially elliptical shape with the ring being reduced about only one of its axis. The ring therefore when held at this angle takes the shape of a circle in its projected view.

The ring is then held in this position with respect to the vertical for running through the casing string, and hanger. When it reaches a support elevation it is rotated to a horizontal position within the slot, and then lowered to the bottom of the slot to establish the landing surface.

DESCRIPTION OF THE PREFERRED EMBODIMENT

Figure 1:
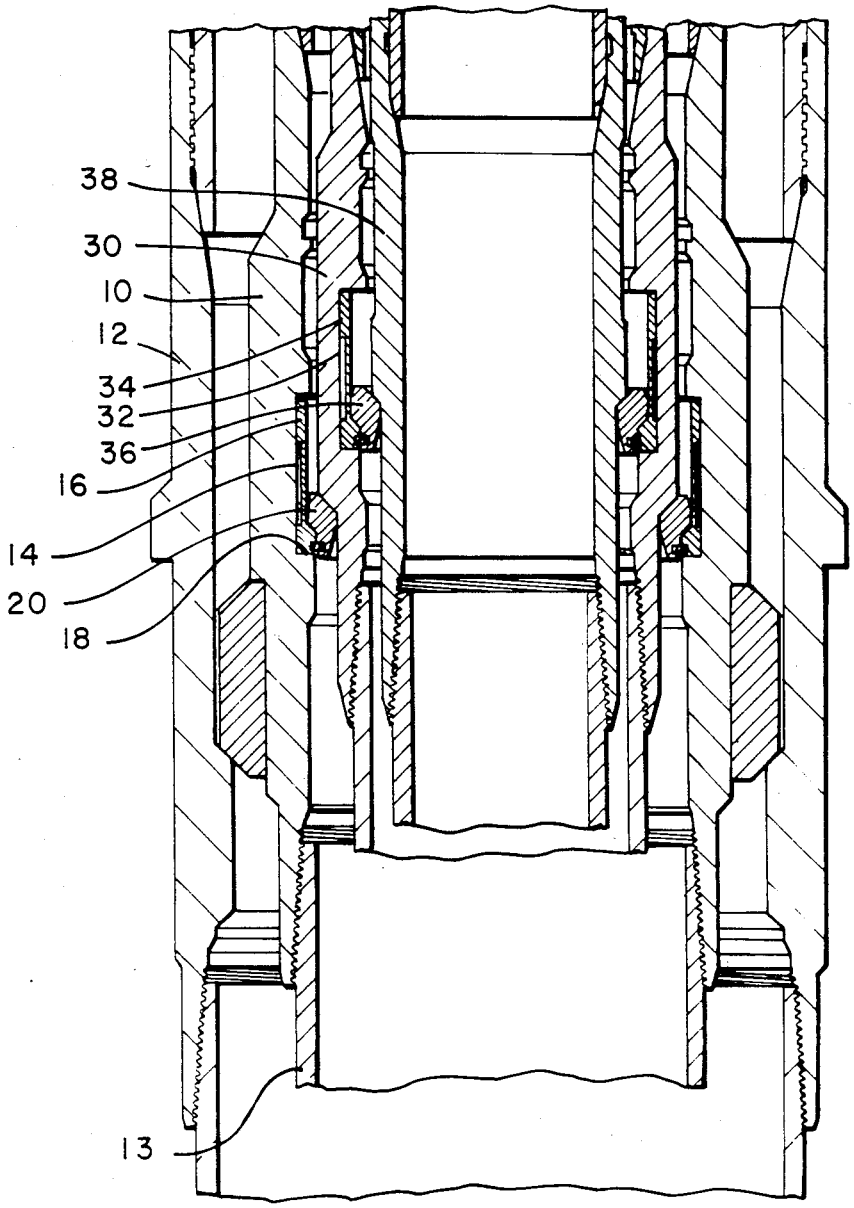
FIG. 1 is a sectional side elevation of the hanger assembly.

Referring to FIG. 1 the 13⅜ inch casing hanger 10 is supported in the conventional manner from the 20 inch casing hanger 12. This hanger has a string of casing 13 depending therefrom, and a string of riser conductor extending upwardly from the casing hanger. The casing hanger 10 has around its inner periphery a vertically extending horizontally oriented slot 14. Within this slot is located a flowby sleeve 16 resting on a support shoulder 18 of the casing hanger body.

A support ring 20 has a downwardly facing support surface 22 (FIG. 2) which bears on the upwardly facing support surface 24 of the flowby sleeve. The support ring 20 has an inwardly extending upwardly facing surface 26 (FIG. 4) which contacts, and supports a landing surface 28 of the 9⅝ inch casing hanger 30. This casing hanger 30 also has an internal slot 32 which houses a flowby sleeve 34. This in turn, carries landing ring 36 which supports the 7 inch casing hanger 38.

Each of the support ring arrangements is substantially the same, and therefore only one will be described in detail.

Figure 2:
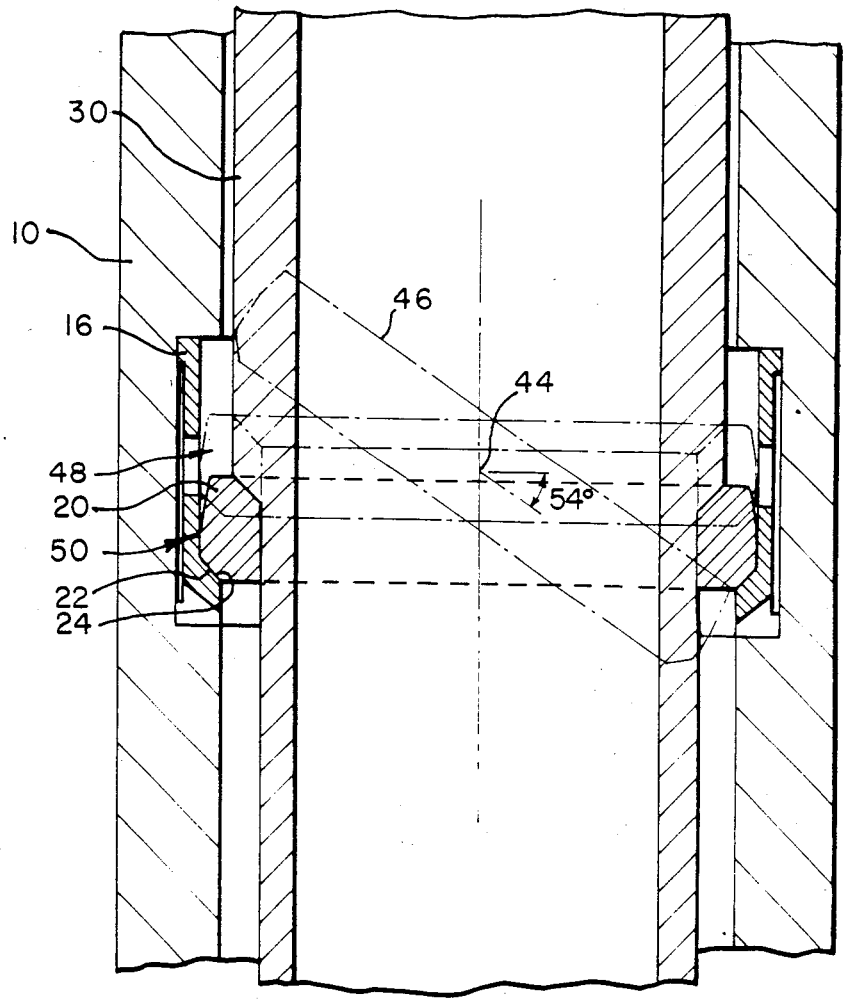
FIG. 2 shows the support ring in two positions.

The inner diameter indicated by surface 40 (FIG. 4) is circular in shape, but the outer diameter indicated by surface 42 is substantially elliptical in shape having the major diameter perpendicular to its axis of rotation 44, the support ring is initially placed at an angle of about 35° from the horizontal as indicated by position 46 of FIG. 2. In this position the elliptical shape, which now has a substantially circular projected view in plan, is capable of passing through the conductor, and first hanger body. When it reaches the support elevation it is rotated to location 48, and then lowered to location 50 where support surface 22 engages support surface 24 of the flowby sleeve 16.

The support ring 20 has an annular slot 52 (FIG. 4) around its outer periphery containing an outwardly expanding split ring 54. The split ring is adapted to fit within an inwardly facing annular slot 56 of the flowby sleeve. Accordingly, after the support ring has been rotated in the horizontal position and lowered, the snap ring 56 engages both the support ring 20, and the flowby sleeve 16, thereby holding the support ring in position.

Figure 3B:
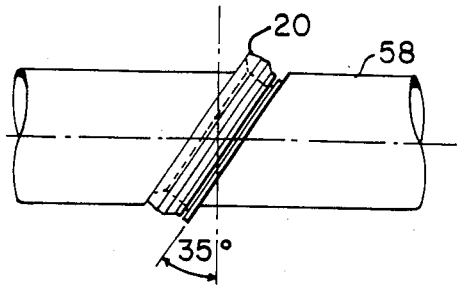
FIG. 3, A and B, shows a method of machining the ring.
Figure 3A:
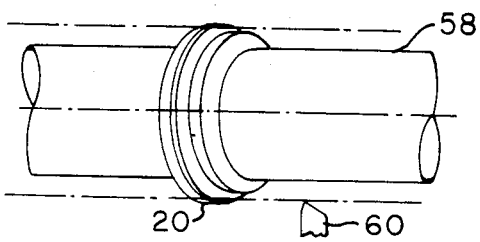
Figure 5:
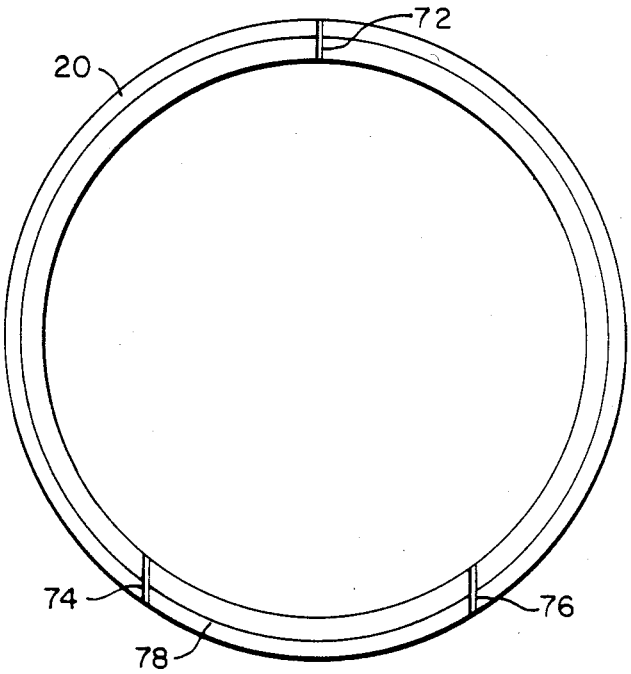
FIG. 5 shows a method of cutting the sleeve.

FIG. 3, A and B, illustrates the method of machining the support ring. The support ring 20 is initially made circular with a preselected inside diameter, and the outside diameter being that of the major diameter of the final ring. The ring is then placed on arbor 58 at an angle of approximately 35° with respect to the plane perpendicular to the axis of rotation of the arbor. The ring 20 is then machined to its final dimensions by machine tool 60, which cuts the ring to the substantially elliptical shape.

Figure 4:
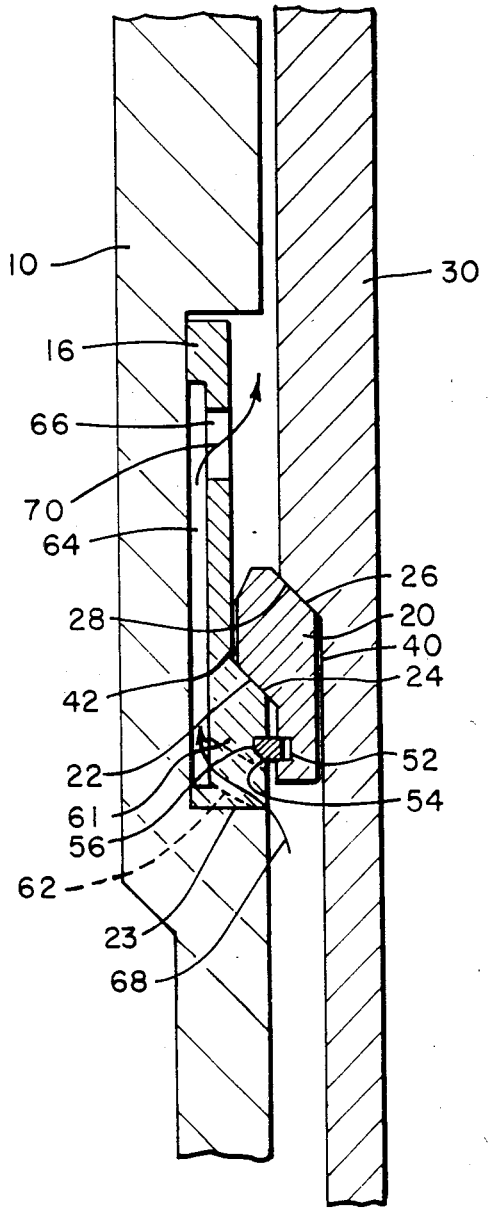
FIG. 4 shows a detail of the sleeve and ring interface.

Referring to FIG. 4 the flowby sleeve 16 has an upwardly facing support surface 24 around the entire circumference of the sleeve. It also has a downwardly facing load surface 23 which engages upwardly facing load surface 18 of the hanger body. It includes an annular support portion 61 between those upwardly facing, and downwardly facing surfaces.

At a plurality of locations around the circumference, there are cut radial openings 62 through the support portion 61. A contiguous vertical flow space 64 is located between the hanger body 10, and the flowby sleeve 16. Contiguous radial openings 66 in the sleeve are located above the support surface 24.

Accordingly, a flowby path shown generally by arrows 68 and 70 provide a flowpath for fluid during cementing operations.

The flowby sleeve 16 is initially machined to a size to fit within the slot. It is thereafter cut into three pieces with cut 72 being radial, and with cuts 74 and 76 being parallel to one another. The sleeve is then inserted within slot 14 with key piece 78 being the last installed. This piece may be slid in radially without interference from the previously installed sections. Thereafter the portions of the ring are welded to one another, but not to the casing hanger body. This operates to retain the ring within the slot. Cut 72 may be omitted if the ring segment can be sprung into place.

Figure 6:
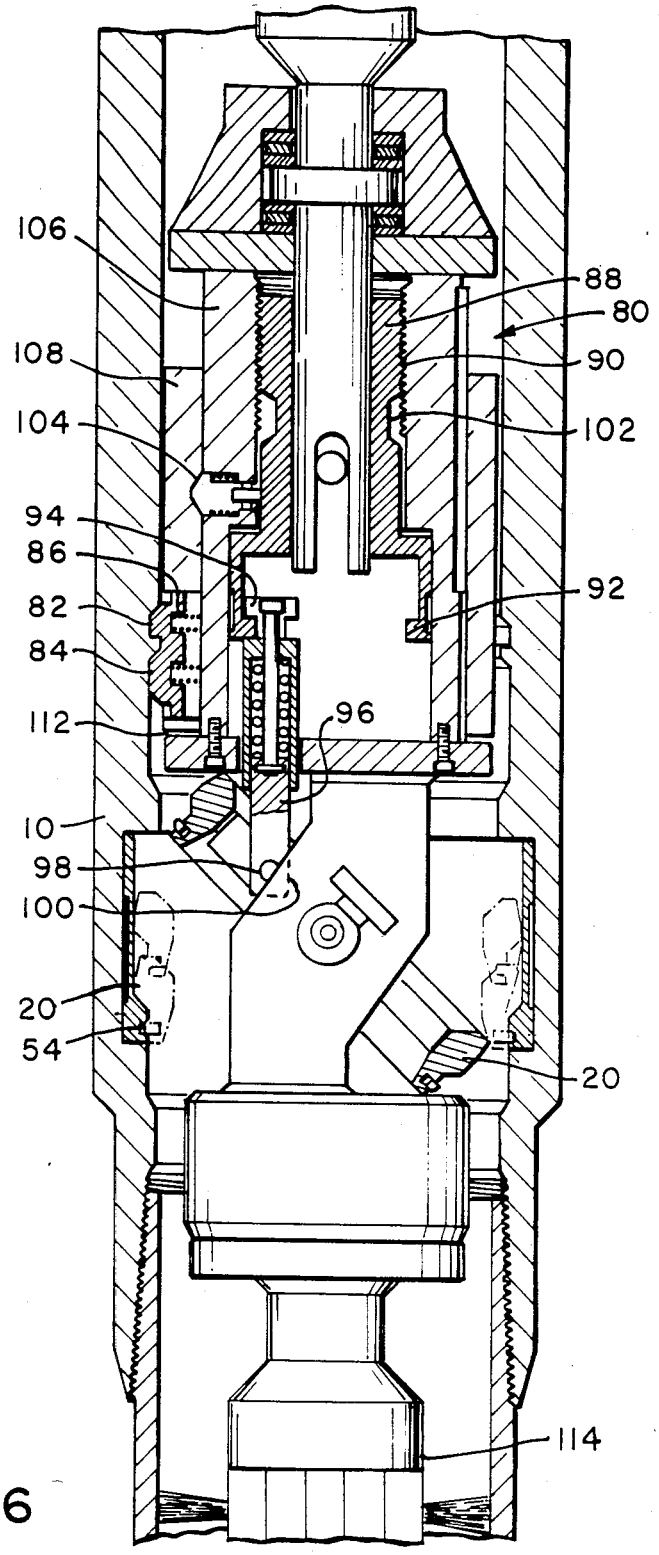
FIG. 6 shows a tool for running the support ring.

Referring to FIG. 6 running tool 80 is used to run, and land the support ring 20. To facilitate this the hanger body 10 has within its inner periphery latch slots 82 at an elevation, a predetermined amount above the support elevation. The running tool has dogs 84 which will mate with these openings.

The tool carries the support ring 20 at an angle with respect to the horizontal, this angle being in the order of 35°. Springs 86 urge the dogs 84 outwardly such that when they reach the appropriate elevation they snap into the slots 82. This stops downward movement of the tool.

The tool is then rotated, turning inner member 88 on threads 90 thereby lowering the lower edge 92 of the tool, and with this upper edge 94 of push rod 96. This operates through pin 98, and slot 100 to rotate ring 16 around a pivot pin 101, to a horizontal position. When sufficient rotation has been achieved to place the ring in a horizontal position, slot 102 comes opposite spring detent 104. This disengages inner member 106 from outer member 108 so that the tool may be moved down farther to place the landing ring 16 in its final position where it is latched in with the snap ring 54.

The ring is then released from the tool by pulling up and shearing the two shear and pivot pins 101. The tool is then free to be pulled to the surface. It is then removed with shoulder 112 picking up dogs 84 to remove the entire apparatus to the surface. A conventional cleaning apparatus 114 may be located at the lower end of the tool if desired.

We claim:

1. A mudline support hanger assembly for supporting a second hanger body within a first hanger body comprising:

a first hanger body having an inside diameter and a vertically extending horizontally oriented slot around its inner circumference, and a load surface near the lower end of the slot;

a substantially elliptical support ring having its major outside diameter greater than the inside diameter of said first hanger body and its minor outside diameter less than the inside diameter of said first hanger body, a support surface at the lower edge of said support ring, a landing surface on the top of said support ring for supporting a later run second hanger body, the inside diameter of said support ring being substantially circular and significantly smaller than said first hanger body inside diameter sufficient to support the second hanger body; and said support ring thereby being capable of passing vertically through the interior of said first hanger body when rotated at an angle around its minor diameter axis, but fitting within said slot when in a horizontal position.

2. A mudline support hanger assembly as in claim 1 having a first annular groove around the outer periphery of said support ring; an outwardly expanding snap ring located within said first annular groove; a second annular groove associated with the slot of a size and location to engage said snap ring when said support ring has landed on said support surface.

3. A mudline support hanger assembly as in claim 1:

a flowby sleeve located within said slot;

an upwardly facing support surface around the inner circumference of said flowby sleeve;

a downwardly facing load surface around a major portion of the bottom of said flowby sleeve, engaging said load surface of said first hanger body;

an annular support portion between said upwardly facing support surface and downwardly facing load surface;

first radial openings through said annular support portion below the landing surface;

vertical flow space between the first hanger body and said flowby sleeve; and second radial openings through said flowby sleeve at a location above said landing surface; said first radial openings, said vertical flow space and said second radial openings being in fluid communication whereby a flow path is provided from below the landing surface through the annular support portion, upwardly outside the flowby sleeve, and through the flowby sleeve to a location above the landing surface.

4. A mudline support hanger assembly as in claim 3:

said flowby sleeve being cut into at least three pieces, and thereafter welded together independent of any welding to the hanger body, whereby the sleeve flowby is retained within the slot.

* * * * *